US011573004B2

(12) United States Patent
Yun

(10) Patent No.: US 11,573,004 B2
(45) Date of Patent: Feb. 7, 2023

(54) LIGHTING DEVICE

(71) Applicant: SHERPA SPACE INC., Daejeon (KR)

(72) Inventor: Choa Mun Yun, Daejeon (KR)

(73) Assignee: SHERPA SPACE INC., Daejeon (KR)

( * ) Notice: Subject to any disclaimer, the term of this patent is extended or adjusted under 35 U.S.C. 154(b) by 0 days.

(21) Appl. No.: 17/106,349

(22) Filed: Nov. 30, 2020

(65) Prior Publication Data

US 2021/0270444 A1 Sep. 2, 2021

(30) Foreign Application Priority Data

Feb. 27, 2020 (KR) ..... 10-2020-0023979

(51) Int. Cl.

| | |
|---|---|
| ***F21V 9/30*** | (2018.01) |
| ***F21V 7/05*** | (2006.01) |
| ***F21V 3/04*** | (2018.01) |
| ***F21Y 105/10*** | (2016.01) |
| ***F21Y 115/10*** | (2016.01) |

(52) U.S. Cl.

CPC ..... *F21V 9/30* (2018.02); *F21V 3/04* (2013.01); *F21V 7/05* (2013.01); *F21Y 2105/10* (2016.08); *F21Y 2115/10* (2016.08)

(58) Field of Classification Search

CPC ..... F21V 3/04; F21V 9/30; F21V 7/30

See application file for complete search history.

(56) References Cited

U.S. PATENT DOCUMENTS

| | | | | |
|---|---|---|---|---|
| 6,653,765 | B1 * | 11/2003 | Levinson | F21K 9/62 313/112 |
| 7,091,653 | B2 * | 8/2006 | Ouderkirk | H01L 33/44 257/E33.072 |
| 9,341,887 | B2 | 5/2016 | Lorne et al. | |
| 2008/0019114 | A1 | 1/2008 | Stuyven | |
| 2011/0175518 | A1 * | 7/2011 | Reed | F21V 7/22 313/483 |
| 2012/0087124 | A1 * | 4/2012 | Ravillisetty | F21V 7/26 362/235 |
| 2012/0236204 | A1 * | 9/2012 | Kasai | G02F 1/133604 348/553 |
| 2013/0270587 | A1 * | 10/2013 | Ouderkirk | G02B 27/141 257/89 |

(Continued)

FOREIGN PATENT DOCUMENTS

| | | | |
|---|---|---|---|
| KR | 100193970 | B1 | 3/1996 |
| KR | 1020100047841 | A | 5/2010 |

(Continued)

OTHER PUBLICATIONS

KR OA dated Apr. 7, 2021.
KR OA dated Feb. 18, 2022.

*Primary Examiner* — Eric T Eide
(74) *Attorney, Agent, or Firm* — Harvest IP Law LLP

(57) ABSTRACT

A lighting device is provided. The lighting device includes: a lighting unit in which a plurality of light sources are mounted; a lighting cover installed to be spaced apart from the lighting unit; and a reflective sheet arranged on a light source mounting surface of the lighting unit and reflecting reflected light reflected from the lighting cover back toward the lighting cover, wherein wavelength conversion layer for converting a wavelength of the reflected light reflected from the lighting cover is laminated on the reflective sheet.

12 Claims, 11 Drawing Sheets

(56) References Cited

U.S. PATENT DOCUMENTS

| | | | | |
|---|---|---|---|---|
| 2015/0124456 | A1* | 5/2015 | Hikmet | F21K 9/64<br>362/293 |
| 2017/0122529 | A1* | 5/2017 | Yamada | F21V 15/01 |
| 2019/0049762 | A1* | 2/2019 | Yonemoto | G02F 1/1336 |

FOREIGN PATENT DOCUMENTS

| | | | |
|---|---|---|---|
| KR | 1020120055195 | A | 5/2012 |
| KR | 1020160067020 | A | 6/2016 |
| KR | 1029100047841 | A | 4/2017 |
| KR | 101792106 | B1 | 11/2017 |
| KR | 101885627 | B1 | 9/2018 |
| KR | 1029160067020 | A | 3/2020 |
| KR | 1020150090693 | A | 7/2020 |

* cited by examiner

LIGHTING DEVICE

CROSS-REFERENCE TO RELATED APPLICATION

This application claims priority from Korean Patent Application No. 10-2020-0023979 filed on Feb. 27, 2020 in the Korean Intellectual Property Office, the disclosure of which is incorporated herein by reference in its entirety.

BACKGROUND

1. Technical Field

Apparatuses and methods consistent with exemplary embodiments relate to a lighting device, and more particularly, to a lighting device in which a light source that is irradiated from a lighting unit and reflected from a lighting cover may be wavelength-converted or scattered to be reflected back in a direction of the lighting cover, thereby enabling to increase the efficiency of the lighting unit by minimizing the loss of light emitted from the lighting unit and to irradiate light having wavelength selected by wavelength conversion of light.

2. Description of the Related Art

Generally, LED (Light Emitting Diode) lighting equipment has a plurality of LEDs arranged in a backlight unit. Because the LED mounted on the backlight unit is a point light source, various technologies have been developed to diffuse a light source and irradiate it with a surface light source.

In order to irradiate the point light source irradiated from the LED with the surface light source, a diffusion plate (or cover) is provided at a position spaced apart in an irradiation direction of the LED, and a technology including various materials for the diffusion plate has been developed.

However, the diffusion plate does not transmit all of the light sources irradiated from the LED, and some are reflected in a direction of the LED, thereby reducing light efficiency.

Accordingly, various technologies have been developed to reflect light reflected from the diffusion plate back to the diffusion plate by providing a reflective plate or a reflective sheet on a substrate on which the LED is mounted.

Among these technologies, an LED array light source is disclosed in Korean Patent No. 10-0193970 (hereinafter referred to "reference 1"). According to reference 1, an upper reflector partially reflecting an output light emitted from an LED array and a lower reflector reflecting the reflected light reflected from the upper reflector back to an emission surface are provided.

In addition, Korean Patent No. 10-1792106 (hereinafter referred to "reference 2") discloses an LED PCB (printed circuit board) module provided with a reflective layer on a metal PCB. According to reference 2, it includes a conductor layer laminated under an LED, a translucent non-conductor layer laminated under the conductor layer, a metal PCB provided under the reflector layer, and a reflector layer laminated between the non-conductor layer and the metal PCB.

Further, Korean Patent No. 10-1885627 (hereinafter referred to "reference 3") discloses an LED luminaire having a high reflection function. According to reference 3, it includes a reflective plate that is mounted on a bottom of a PCB and is injection-molded with a polycarbonate resin to reflect an upper surface of a light diffusion plate and has a highly reflective surface on a lower surface to reflect downwardly incident illumination light.

However, the techniques described above are merely techniques of reflecting reflected light again, and have a disadvantage that may not be applied to various fields because a wavelength of light may not be changed.

U.S. Pat. No. 9,341,887 (hereinafter referred to "reference 4") discloses a reflector including an ESR (erythrocyte sedimentation rate) layer such as white ink or white paint or a diffused scatterer to re-reflect reflected light. U.S. Patent Publication No. US 2008/0019114 (hereinafter referred to "reference 5") discloses that a film having a reflective surface to minimize leakage of light is installed, in which the film includes a white diffusion reflecting film.

According to the references, there is a problem in that the light emitted from the LED is reflected and the light returned to the LED is reflected again, but wavelength conversion and light scattering may not be expected during a reflection process.

3. Bibliography

[Project Unique Number] 1425136755
[Project Number] S2799140
[Organization Name] Ministry of SMEs and Startups
[Project Management Organization] Korea Technology and Information Promotion
Agency for SMEs
[Research Business Name] Startup Growth—Technology Development Business
[Research Project Name] Development of optical editing solution for producing low energy/high productivity medical cannabis
[Management Organization] Sherpa Space Inc.
[Research Period] Nov. 25, 2019~Nov. 24, 2021

SUMMARY

Aspects of one or more exemplary embodiments provide a lighting device in which light reflected from a lighting cover and returned to a lighting unit is re-reflected to the lighting cover, in which the re-reflected light is wavelength converted and scattered.

Aspects of one or more exemplary embodiments also provide a lighting device capable of irradiating light of various colors through wavelength conversion even for a lighting unit that has a pure chip-state LED without a resin material for light diffusion or a phosphor for color conversion.

According to an aspect of an exemplary embodiment, there is provided a lighting device including: a lighting unit in which a plurality of light sources are mounted; a lighting cover installed to be spaced apart from the lighting unit; and a reflective sheet arranged on a light source mounting surface of the lighting unit and reflecting reflected light reflected from the lighting cover back toward the lighting cover, wherein wavelength conversion layer for converting a wavelength of the reflected light reflected from the lighting cover may be laminated on the reflective sheet.

According to an aspect of another exemplary embodiment, there is provided a lighting device including: a lighting unit in which a plurality of light sources are mounted; a lighting cover installed to be spaced apart from the lighting unit; and a reflective sheet installed on a light source mounting surface of the lighting unit and reflecting reflected light reflected from the lighting cover back toward the lighting cover, wherein the reflective sheet may include a mixed layer in which wavelength conversion material for converting a wavelength of the reflected light reflected from the lighting cover and a scattering material for scattering the reflected light may be mixed.

According to an aspect of another exemplary embodiment, there is provided a lighting device including: a lighting unit in which a plurality of light sources are mounted and in which a reflective area is formed between the plurality of light sources; and a lighting cover installed to be spaced apart from the lighting unit, wherein the reflective area may include a reflective layer that reflects reflected light reflected from the lighting cover back toward the lighting cover, and wherein wavelength conversion material for converting a wavelength of the reflected light and a scattering material for scattering the reflected light may be laminated and applied on the reflective layer.

According to an aspect of another exemplary embodiment, there is provided a lighting device including: a lighting unit in which a plurality of light sources are mounted and in which a reflective area is formed between the plurality of light sources; and a lighting cover installed to be spaced apart from the lighting unit, wherein the reflective area may include a reflective layer that reflects reflected light reflected from the lighting cover back toward the lighting cover, and wherein a mixture of a wavelength conversion material for converting a wavelength of the reflected light and a scattering material for scattering the reflected light may be applied on the reflective layer.

The reflective sheet may include a scattering layer for scattering the reflected light reflected from the lighting cover.

The wavelength conversion layer may include at least one of an inorganic phosphor, a quantum dot, and a perovskite.

An edge of the reflective sheet may be formed to be bent in a direction of the lighting cover.

The light source may be configured as an LED bare chip package.

According to one or more exemplary embodiments, light reflected from a lighting cover is wavelength-converted and scattered in a reflective sheet and reflected back to the lighting cover. Therefore, light efficiency may be improved by minimizing the loss of light emitted from the lighting cover. In addition, as the reflected light source scatters, a pointing angle may be improved.

Moreover, various colors may be expressed by selecting wavelength conversion material and a particle size.

Also, even in a lighting unit that does not have a resin or phosphor applied on an LED, it is possible to irradiate light of various colors by converting wavelength. Therefore, heat generated by the LED may be easily dissipated to extend a life expectancy of a lighting device. Furthermore, because a manufacturing process of the lighting unit using the LED is partially omitted, a defect rate may be reduced and it is possible to reduce a manufacturing cost of the lighting unit.

BRIEF DESCRIPTION OF THE DRAWINGS

The above and other aspects and features will become more apparent from the following description of the exemplary embodiments with reference to the accompanying drawings, in which.

DETAILED DESCRIPTION

Figure 1A:
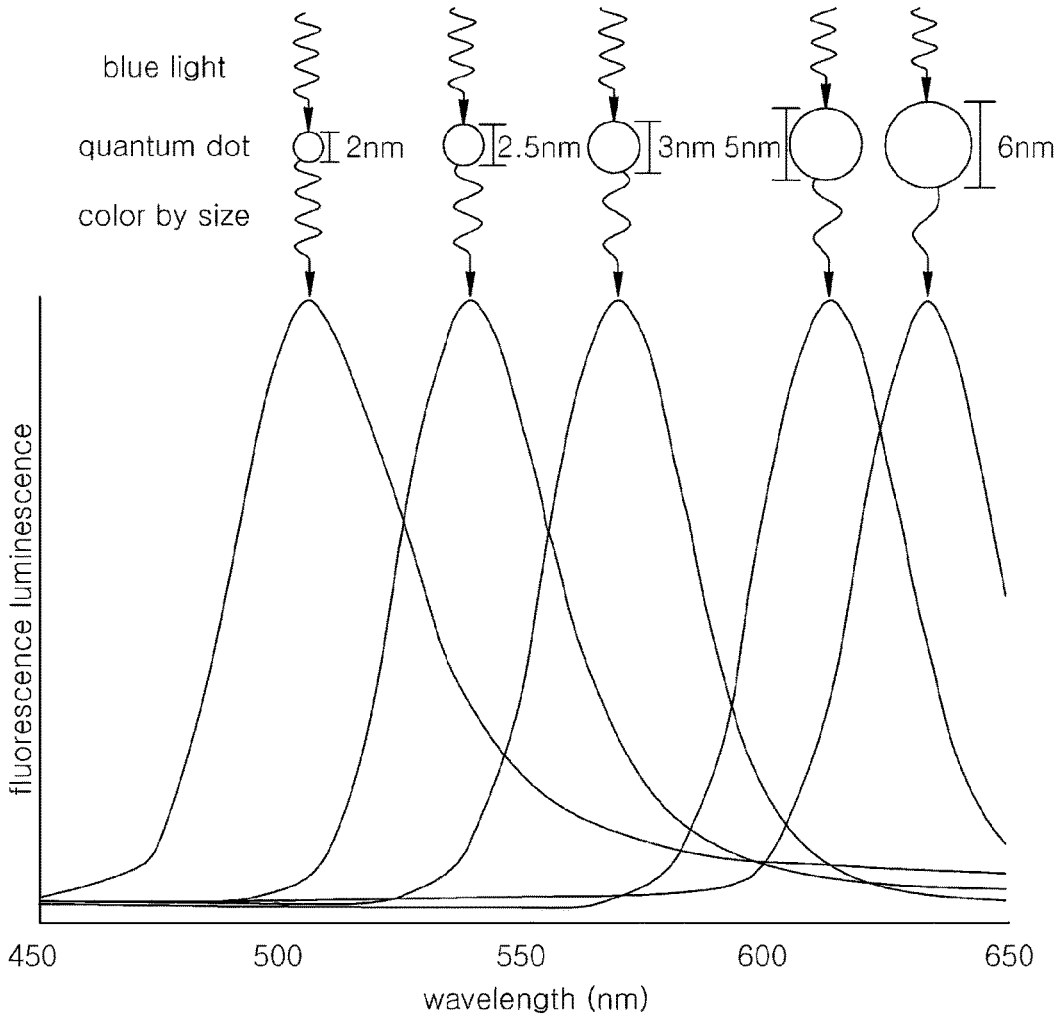
FIGS. 1A and 1B are conceptual views for explaining a principle of a quantum dot, respectively.

Various modifications and various embodiments will be described in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

When a component is referred to as being "coupled" or "connected" to another component, it should be understood that it may be directly coupled to or connected to another component, but other components may exist in the middle.

On the other hand, when a component is referred to as being "directly coupled" or "directly connected" to another component, it should be understood that there are no other components in the middle.

Terms used herein are only used to describe specific embodiments, and are not intended to limit the present disclosure. Unless the context clearly means otherwise, the singular expression includes plural expression. It should be understood that, herein, the terms "comprises" or "have," etc. are intended to specify that there is a stated feature, number, process, operation, component, part, or a combination thereof herein, and it does not exclude in advance the possibility of presence or addition of one or more other features, numbers, processes, operations, components, parts, or combinations thereof.

Unless otherwise defined, all terms used herein, including technical and scientific terms, have the same meaning as commonly understood by those of ordinary skill in the art to which the present disclosure belongs. Terms as defined in a commonly used dictionary should be interpreted as having a meaning consistent with the meaning of the related technology, and they are not to be construed in an ideal or excessively formal sense unless explicitly defined in the present application.

Expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, all of a, b, and c, or any variations of the aforementioned examples.

The term module or part described herein means a unit that processes a specific function or operation, and may mean hardware or software, or a combination of hardware and software. Further, a plurality of "modules" or "parts" may be integrated into at least one module and implemented as at least one processor, except "modules" or "parts" that need to be implemented as specific hardware.

Terms or words used in the specification and claims should not be construed as being limited to their conventional or dictionary meanings. They should be interpreted as meanings and concepts consistent with the technical idea of the present disclosure, based on the principle that the inventor may appropriately define the concept of terms in order to describe his own invention in the best way. In addition, unless there are other definitions of technical and scientific terms used, they have the meanings commonly understood by those of ordinary skill in the art to which this invention belongs. In the following description and the accompanying drawings, descriptions of known functions and configurations that may unnecessarily obscure the subject matter of the present disclosure will be omitted. The drawings introduced below are provided as examples in order to sufficiently convey the spirit of the present disclosure to those skilled in the art. Accordingly, the present disclosure is not limited to the drawings presented below and may be embodied in other forms. In addition, the same reference numerals throughout the specification indicate the same components. It should be noted that the same components in the drawings are indicated by the same reference numerals wherever possible.

Prior to the detailed description of the present disclosure, the principle of converting and outputting a specific wavelength using a quantum dot which is an example of wavelength conversion material will be described as follows.

Figure 1B:
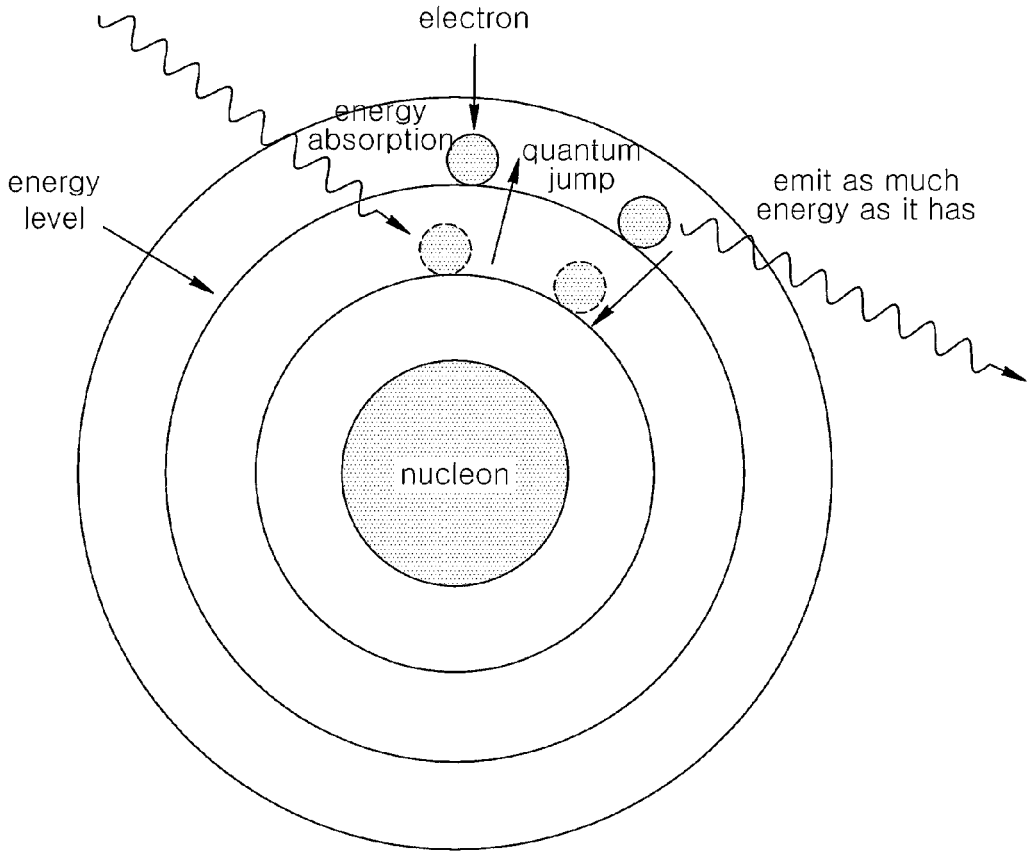

FIGS. 1A and 1B are conceptual views for explaining a principle of a quantum dot, respectively.

The quantum dot refers to a semiconductor crystal synthesized by a nanometer (nm) unit. When the quantum dot is irradiated with ultraviolet light (e.g., blue light), even particles of the same component emit various colors depending on a size of a particle. These properties are better represented by semiconductor materials than by ordinary materials. In a quantum dot semiconductor crystal, elements such as cadmium, cadmium sulfide, cadmium selenide, and indium phosphide having such characteristics are used. Recently, indium phosphide cores are covered with a zinc-selenium-sulfur alloy (ZnSeS) to remove cadmium, a heavy metal.

As shown in FIG. 1A, when a particle size of the quantum dot is small, it emits visible light with a short wavelength such as green. As its size increases, it emits visible light with a longer wavelength like red. In general, it has a characteristic of emitting energy of various wavelengths by adjusting a band gap energy according to the size of the quantum dot by the quantum confinement effect. In other words, as an energy level of electrons decreases inside the quantum dot, light is emitted. The larger the size of the quantum dot, the narrower the energy levels are. Therefore, long wavelength red color with relatively low energy is emitted.

Here, the quantum confinement effect is a phenomenon in which electrons form a discontinuous energy state by a space wall when a particle is less than several tens of nanometers, and as a size of the space decreases, the energy state of the electrons increases and has a wide band energy.

Referring to FIG. 1B, the principle of quantum dot is that when electrons in a semiconductor material to which protons are bonded receive energy such as ultraviolet rays, they rise to a higher energy level by quantum jump, then release energy again and repeat to fall to a lower energy level. This energy emits energy of various wavelengths depending on the size of the quantum dot. If the wavelength (i.e., energy) is in the visible light band (e.g., 380 nm-800 nm), it emits various visible colors as wavelengths in the form of energy.

In other words, when the quantum dot absorbs light from an excitation source and reaches an energy excited state, it emits energy corresponding to an energy band gap of the quantum dot. Therefore, by controlling the size or material composition of the quantum dot, it is possible to adjust the energy band gap, so that light emission in all areas from the ultraviolet region to the infrared region is possible.

As a method for manufacturing a quantum dot, a vapor deposition method such as metal organic chemical vapor deposition (MOCVD) or molecular beam epitaxy (MBE) may be used, or a wet chemical synthesis method may be used. Quantum dots manufactured by the wet chemical synthesis method are dispersed in a solvent in a colloidal state. Therefore, the quantum dots are separated from the solvent through centrifugation, and the separated quantum dots may be dispersed in a prepared metal-organic precursor solution. Here, the quantum dot may be stabilized by bonding of a metal-organic precursor to an organic material.

When these quantum dots are applied by dividing an area on a transparent material film by type, and artificial light such as LED is incident, only light of a specific wavelength preset by a user for each characteristic of the quantum dot is output. Naturally, a third wavelength may be set by mixing and distributing at least two or more kinds of quantum dots in a certain application region of a film.

Figure 1C:
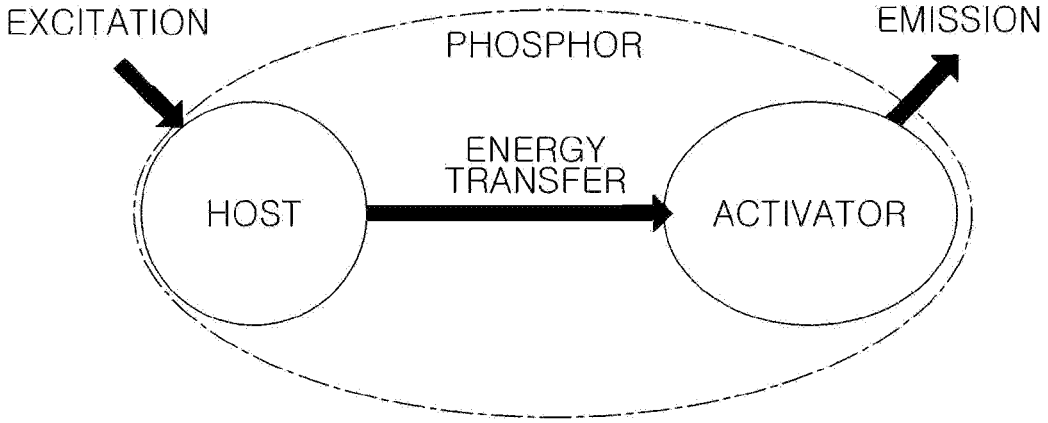
FIG. 1C is a view showing a luminescence principle of a phosphor.

Next, a principle of selectively sensing a specific wavelength or selectively outputting a specific wavelength using an inorganic phosphor will be described. FIG. 1C is a view showing a luminescence principle of a phosphor.

When a certain type of energy is incident inside a particle, visible light is produced by a certain action within the particle. This process is called luminescence. For the light emission principle of phosphor, when a phosphor receives energy, free electrons and holes are formed, and it changes into a high-level energy state. As it returns to its stable state, its energy is emitted as visible light. The phosphor is composed of a host material and an activator in which impurities are mixed at an appropriate position. Active ions determine a luminescence color of the phosphor by determining an energy level involved in a luminescence process.

Therefore, it uses the principle that phosphors containing active ions that emit light of a specific wavelength are applied or colored by dividing an area on a transparent material film for each type, and then when artificial light such as LED is incident, only light of a specific wavelength preset by a user for each characteristic of the phosphor is output. Naturally, a third wavelength may be set in a manner in which at least two or more types of phosphors are mixed and applied on a certain application area of a film.

Figure 2:
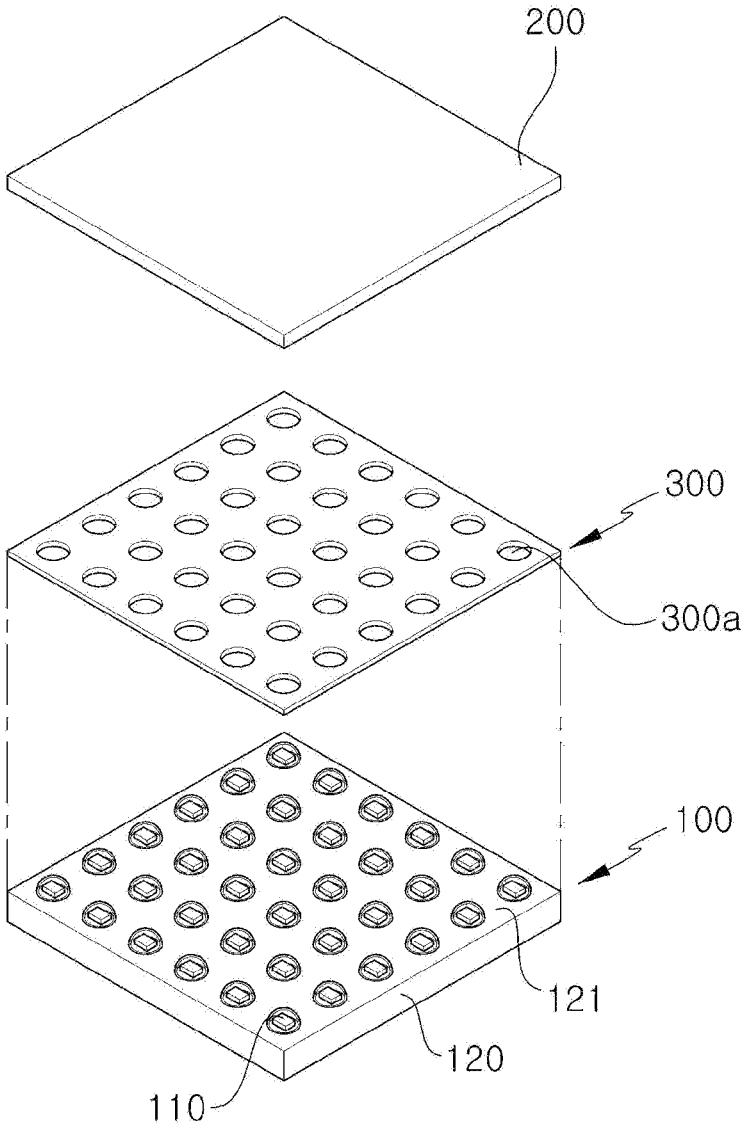
FIG. 2 is an exploded perspective view schematically showing a main configuration of a lighting device according to the present disclosure.

FIG. 2 is an exploded perspective view schematically showing a main configuration of a lighting device according to an exemplary embodiment.

Referring to FIG. 2, a lighting device according to an exemplary embodiment includes a lighting unit 100, a lighting cover 200, and a reflective sheet 300.

The lighting unit 100 is equipped with a plurality of light sources 110 to emit light according to an application of electric energy, and may include an inverter that converts the light source 110 into a power suitable for driving, and a control module that controls on/off of the power. Here, the light source is defined as an optical emitter configured to generate and emit light. For example, the light source may include an optical emitter, such as a light emitting diode (LED), which emits light when activated or turned on. For example, the light source 110 defined in the exemplary embodiment may be substantially any light source, and may include any optical emitter including one or more of a light emitting diode (LED), a laser, an organic light emitting diode (OLED), a polymer light emitting diode, a plasma-based optical emitter, a fluorescent lamp, an incandescent lamp, and virtually any other light source. Light produced by the light source may have a color (i.e., may contain a specific wavelength of light), or may be a range of wavelengths (e.g., white light). In some exemplary embodiments, the light source may include a plurality of various optical emitters. Further, the light source may comprise a set or group, and generate light having a color or wavelength different from or equal to a color of light generated by at least one other light source in the set or group. Different colors may include, for example, a primary color (e.g., red, green, blue).

If the light source 110 of the lighting unit 100 is an LED (light emitting diode) package, the plurality of light sources 110 are electrically connected to a circuit board 120. Here, the circuit board 120 may be formed of a metal PCB (printed circuit board) made of a metal material, and a heat sink or the like for dissipating generated heat may be installed under the circuit board 120. In addition, the circuit board 120 includes a conductor layer and a non-conductor layer forming a conductive pattern, and is configured to apply electric energy to the light source 110. In addition, the light source 110 is coated on an encapsulant (e.g., resin and phosphor, etc.).

The light source 110 in FIG. 2 is illustrated in a form protruding from a light source mounting surface 121 of the circuit board 120, but it is understood that it may be configured in a form recessed in the circuit board 120.

According to design conditions, the light source 110 may be composed of one or more combinations selected from various colors including red, orange, yellow, yellow green, pure green, and blue, and may be arranged in various patterns.

The lighting cover 200 is installed to be spaced apart from the lighting unit 100, and transmits a light source emitted from the lighting unit 100.

The lighting cover 200 may be implemented in various forms depending on an environment in which the lighting device is installed. For example, as shown in FIG. 2, it may be configured in a planar shape, a hemisphere, or an arc shape in cross section, or a flexible material capable of being rolled or bent.

In addition, the lighting cover 200 includes a conversion layer 210 for converting and emitting a wavelength of incident light.

Figure 3:
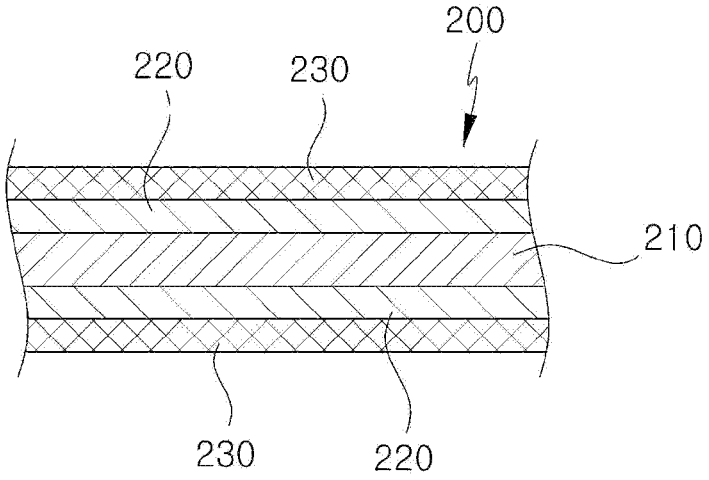
FIG. 3 is a partial cross-sectional view of a lighting cover of a lighting device according to an exemplary embodiment.

FIG. 3 shows a partial cross-sectional view of a lighting cover of a lighting device according to an exemplary embodiment.

Referring to FIG. 3, the lighting cover 200 includes a conversion layer 210, a barrier film 220, and a composite film 230.

The conversion layer 210 converts a wavelength of a light source (i.e., light) emitted from the light source 110 of the lighting unit 100 and a light source (i.e., light) reflected from the reflective sheet 300 to be emitted, and contains wavelength conversion material. Alternatively, the conversion layer 210 may have a structure in which a conversion layer including the wavelength conversion material for converting the wavelength of the light source and a scattering layer including a scattering material for scattering the light source are laminated, and may be configured as a mixture of the wavelength conversion material and the scattering material.

The barrier film 220 made of a PET (Polyester) material may be coated on one surface or upper and lower surfaces of the conversion layer 210.

In addition, one surface or the upper and lower surfaces of the barrier film 220 may be coated once more with the composite film 230 that increases support. Here, the composite film 230 may be a film-type substrate having excellent transparency and heat resistance. The film-type substrate may be selected from polyesters such as poly(meth)acrylate, polyethylene terephthalate (PET), polybutylene terephthalate (PBT), polyethylene naphthalate (PEN), and polyarylate; resins such as polycarbonate, polyvinyl chloride, polyethylene, polypropylene, polystyrene, aliphatic or aromatic polyamide (e.g., nylon, aramid, etc.), polyetheretherketone, polysulfone, polyethersulfone, polyimide, polyamideimide, polyetherimide, cyclic olefin polymer (COP), polyvinylidene chloride.

The lighting cover 200 receives the light source (i.e., light) emitted from the light source 110 of the lighting unit 100, converts the wavelength of the light, and emits it.

However, not only the lighting cover 200 of the exemplary embodiment, but also a lighting cover having excellent light transmittance, may not transmit all incident light. In other words, most of the incident light sources pass through the lighting cover and may be irradiated to an effective light source, but some are reflected from the lighting cover.

Accordingly, in the exemplary embodiment, the reflection sheet 300 is configured to reflect a light source incident on the circuit board 120 on which the light source 110 is disposed among the light sources reflected from the lighting cover 200 back to the lighting cover 200.

Figure 4:
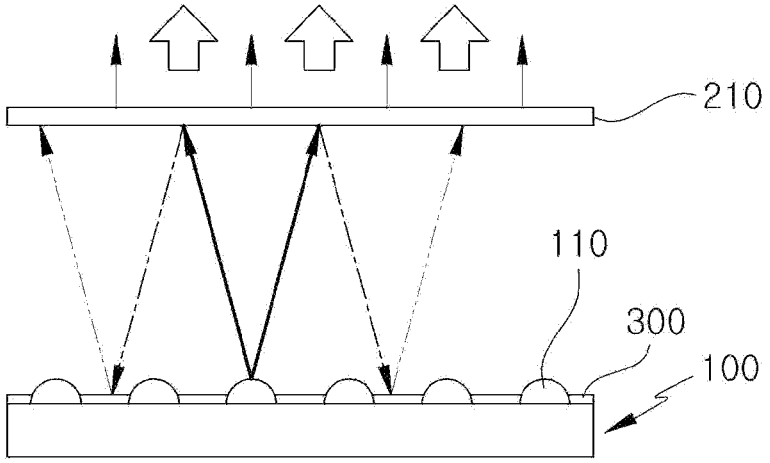
FIG. 4 is a view for explaining a reflection process of a light source in a lighting device according to an exemplary embodiment.

FIG. 4 is a view for explaining a reflection process of a light source in a lighting device according to an exemplary embodiment. Referring to FIG. 4, light source emitted from the light source 110 proceeds toward the lighting cover 200 and is mostly emitted through the lighting cover 200. Here, some of the light sources emitted from the light source 110 are reflected by the lighting cover 200, and the reflected light source is incident on the reflective sheet 300.

The reflective sheet 300 performs a function of reflecting the light source reflected from the lighting cover 200 back to the lighting cover 200. Referring to FIG. 2, the reflective sheet 300 is arranged on the light source mounting surface 121, and a through hole **300*a* is formed corresponding to the plurality of light sources 110**.

Figure 5:
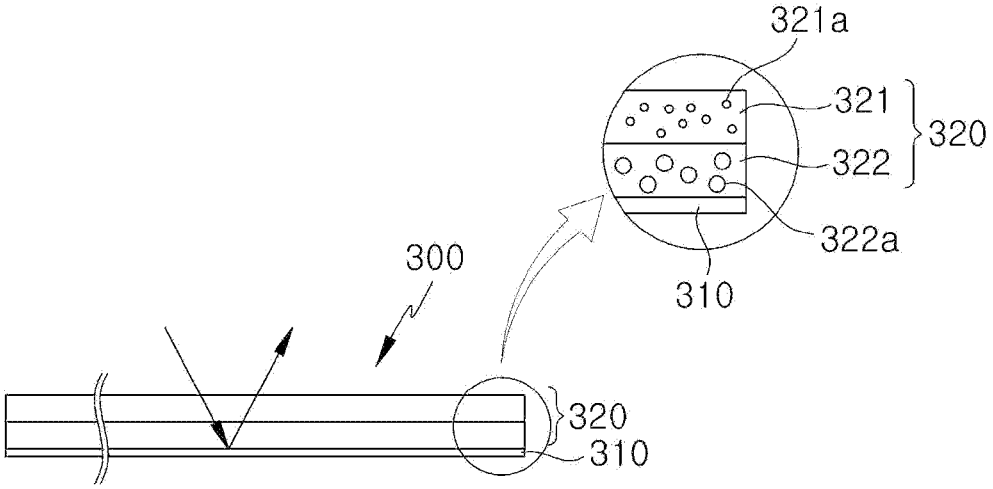
FIG. 5 is a side cross-sectional view of a reflective sheet applied to a lighting device according to another exemplary embodiment.

FIG. 5 is a side cross-sectional view of a reflective sheet applied to a lighting device according to another exemplary embodiment.

Referring to FIG. 5, the reflective sheet 300 includes a reflective layer 310 and a base layer 320.

The reflective layer 310 reflects an incident light source. The reflective layer 310 may be composed of any one material selected from copper, silver, aluminum, tin, gold, brass, bronze, and stainless steel, which may expect high reflective efficiency, but any material that may reflect a light source may be used.

The base layer 320 is arranged on the reflective layer 310 to convert and/or scatter a wavelength of incident light, and includes wavelength conversion layer 321 and a scattering layer 322.

First, the wavelength conversion layer 321 converts the wavelength of the incident light.

Thus, the wavelength conversion layer 321 includes wavelength conversion material 321*a* for converting the wavelength of the incident light, in which the wavelength conversion material includes at least one of an inorganic phosphor, a quantum dot, and a perovskite. In other words, the wavelength conversion layer 321 may include one wavelength conversion material selected from an inorganic phosphor, a quantum dot, and a perovskite, or a mixture of two or more of them.

The inorganic phosphor may be any one selected from a group consisting of an oxide-based phosphor, a garnet-based phosphor, a silicate-based phosphor, a sulfide-based phosphor, an oxynitride-based phosphor, a nitride-based phosphor, and a mixture thereof.

The quantum dot may be, for example, II-VI or III-V group, and representative examples thereof may be any one selected from a group consisting of CdS, CdSe, CdTe, ZnS, ZnSe, ZnTe, HgS, HgSe, HgTe, GaN, GaP, GaAs, GaSb, AlN, AlP, AlAs, AlSb, InN, InP, InAs, InSb, Si, Ge, and a mixture thereof.

The perovskite is also referred to as organometallic halide, organometallic halide perovskite compound, or organometallic halide. Among materials having a perovskite structure, the organometallic halide is composed of an organic cation (A), a metal cation (M), and a halogen anion (X), and has a chemical formula of $AMX_3$.

In the wavelength conversion layer 321 including the wavelength conversion material as described above, the incident light source is converted into various wavelengths by adjusting a band gap energy according to a particle size of the wavelength conversion material and then emitted. In other words, if the particle size of the wavelength conversion material constituting the wavelength conversion layer 321 is adjusted, the wavelength of the light source emitted through the wavelength conversion layer 321 may be adjusted.

For example, if the particle size of the wavelength conversion material is 2 to 6 nm and the incident light source is blue while each particle is uniformly distributed, colors emitted from the wavelength conversion layer 321 are converted into blue, green, and red wavelengths to be emitted.

The scattering layer 322 scatters the incident light and diffusely reflects it, and includes a scattering material 322*a* that scatters the incident light.

The scattering material 322*a* may be selected from polyacrylate-based polymers such as PMMA and PS, silicone-based polymers such as PMSQ, and inorganic dispersants such as $SiO_2$, $TiO_2$, and $Al_2O_3$. Here, the scattering material has a wider range of scattering angles as a particle size decreases, in which a degree of scattering varies depending on a wavelength of a light source and a size of a particle. In other words, the scattering range may be adjusted by controlling the size of the scattering particles of the scattering material according to the wavelength of the light source, and the scattering angle may be adjusted according to a pointing angle.

In addition, incident light of the reflected light source sequentially passes through the wavelength conversion layer 321 and the scattering layer 322 of the base layer 320 and is reflected by the reflective layer 310, and the reflected light source is reflected by passing through the scattering layer 322 and the wavelength conversion layer 321 in sequence again. However, it is understood that this is only an example. For example, a lamination order of the scattering layer 322 and the wavelength conversion layer 321 may be changed according to design conditions.

Because the reflective sheet 300 performs at least two wavelength conversions and two scatterings until the incident light source is reflected and emitted, the efficiency of wavelength conversion and scattering is increased.

Figure 6:
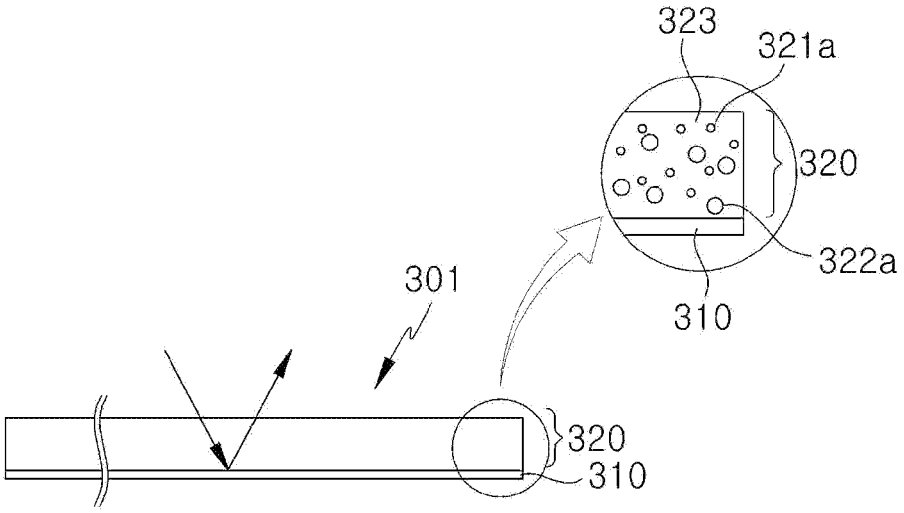
FIG. 6 is a side cross-sectional view of a reflective sheet applied to a lighting device according to another exemplary embodiment.

FIG. 6 shows a side cross-sectional view of a reflective sheet applied to a lighting device according to another exemplary embodiment.

Referring to FIG. 6, a reflective sheet 301 includes a reflective layer 310 and a base layer 320.

The reflective layer 310 reflects an incident light source. The base layer 320 is arranged on the reflective layer 310 to convert and scatter a wavelength of the incident light, and includes a mixed layer 323.

The mixed layer 323 includes a mixture of a wavelength conversion material 321*a* for converting the wavelength of the incident light and a scattering material 322*a* for scattering the incident light.

The wavelength conversion material 321*a* includes at least one of an inorganic phosphor, a quantum dot, and a perovskite. In other words, the mixed layer 323 may include one wavelength conversion material selected from an inorganic phosphor, a quantum dot, and a perovskite, or a mixture of two or more of them.

The scattering material 322*a* may be selected from polyacrylate-based polymers such as PMMA and PS, silicone-based polymers such as PMSQ, and inorganic dispersants such as $SiO_2$, $TiO_2$, and $Al_2O_3$.

In the configuration of the reflective sheets 300 and 301 of FIGS. 5 and 6, a light source incident on an edge of the reflective sheet may be reflected from the reflective sheet and may not proceed toward the lighting cover 200 and may be reflected outside an area of the reflective sheet.

Accordingly, in order to induce the light source reflected from the lighting cover 200 to proceed toward the reflective sheet, and to induce the light source reflected from the reflective sheet toward the lighting cover 200, the edge of the reflective sheet may be formed to be bent toward the lighting cover 200.

Figure 7:
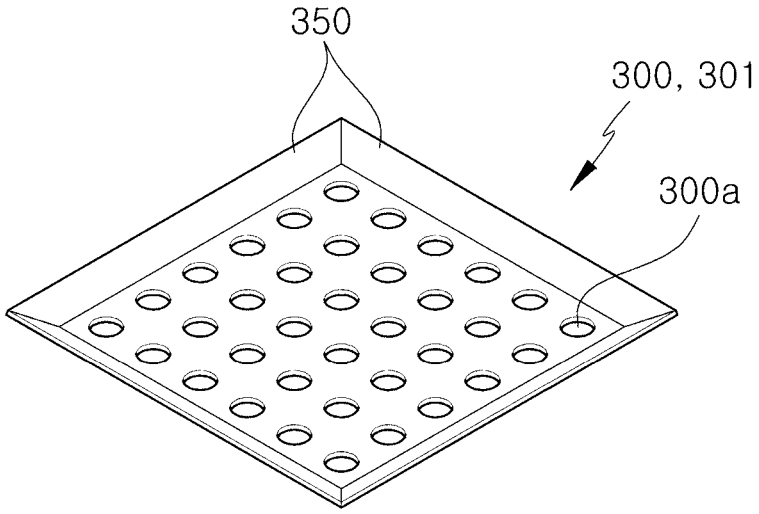
FIG. 7 is a perspective view of a reflective sheet applied to a lighting device according to another exemplary embodiment.

FIG. 7 shows a perspective view of a reflective sheet applied to a lighting device according to another exemplary embodiment.

Referring to FIG. 7, an edge of the reflective sheets 300 and 301 are formed with a wing 350 that are bent toward (i.e., direction) the lighting cover 200. Here, a bending degree (i.e., angle) and width of the wing 350 may be formed differently depending on a distance between the reflective sheets 300 and 301 and the lighting cover 200, a steering angle of a light source, and a use of a lighting device.

Because the wings 350 are formed on the reflective sheets 300 and 301, loss of the light source reflected from the lighting cover 200 and the light source reflected and returned may be further minimized. Therefore, relatively higher light efficiency may be expected compared to a reflective sheet in which the wing is not formed.

If a light source of a lighting unit includes a light emitting diode (LED) package, an LED package is arranged on a circuit board on which a conductor layer and a non-conductor layer are formed, an LED chip is arranged thereon, and an encapsulant (e.g., resin material, phosphor, etc.) is coated on the LED chip. In other words, in the exemplary embodiment, the LED package is defined to include a circuit board on which a conductor layer and a non-conductor layer are formed, an LED chip, a phosphor, an encapsulant (for example, an epoxy resin), a lens and a heat dissipating component, or the like.

Here, the encapsulant surrounds the LED chip and serves to protect the LED chip from external impact and environment. Because a light source emitted from the LED chip must pass through the encapsulant in order to come out from the LED chip, the encapsulant must have high optical transparency, that is, high light transmittance. In addition, it is required to have a high refractive index suitable for enhancing light extraction efficiency. Furthermore, high heat dissipation characteristics are also required to prevent degradation characteristics of the LED chip.

As a related art encapsulant, an epoxy resin having a high refractive index and low price has been widely used. However, the epoxy resin has low heat resistance, so there is a problem that it is deteriorated by heat in a high-power LED chip, and it is yellowed by light in the vicinity of blue and ultraviolet rays in a white light LED chip, thereby reducing luminance. Alternatively, a silicone resin having excellent light resistance in a low wavelength region is used (e.g., a bonding energy of siloxane bond (Si—O—Si) of a silicone resin is 106 kcal/mol, which is higher than a carbon-carbon (C—C) bond energy by 20 kcal/mol or more, and thus has good heat resistance and light resistance). However, the silicone resin has a problem of low refractive index, low light extraction efficiency, and poor adhesion.

In addition, in order to convert a color emitted from the LED chip, a phosphor is mixed with a resin and used, or a resin and a phosphor are laminated and used. For example, when a blue LED chip emitting blue light is used, a method for converting color into white light by using an encapsulant in which a resin and a yellow phosphor are mixed is known. In addition, a method for forming such a resin in a plate shape and sealing it by pressing on an LED chip is known.

If an LED chip is coated using a resin as an encapsulant, the resin is liable to deteriorate due to a high temperature generated in the LED chip and a luminous color may be changed. In addition, as a process of manufacturing and coating a suitable encapsulant is further added, the process becomes complicated, and the manufacturing cost increases.

Accordingly, according to another exemplary embodiment, a lighting device using an LED bare chip package capable of converting a color of an LED chip without performing a coating such as an encapsulant on the LED chip is proposed. In other words, the LED bare chip package includes a circuit board on which a conductor layer and a non-conductor layer are formed, and an LED chip on the circuit board, in which an encapsulant (e.g., resin material, phosphor, etc.) is not coated on a top of the LED chip. In other words, in the exemplary embodiment, the LED bare chip package includes a circuit board on which a conductor layer and a non-conductor layer are formed, an LED chip, a phosphor and a heat dissipating component, or the like, but an encapsulant and a phosphor are not applied or coated.

Figure 8:
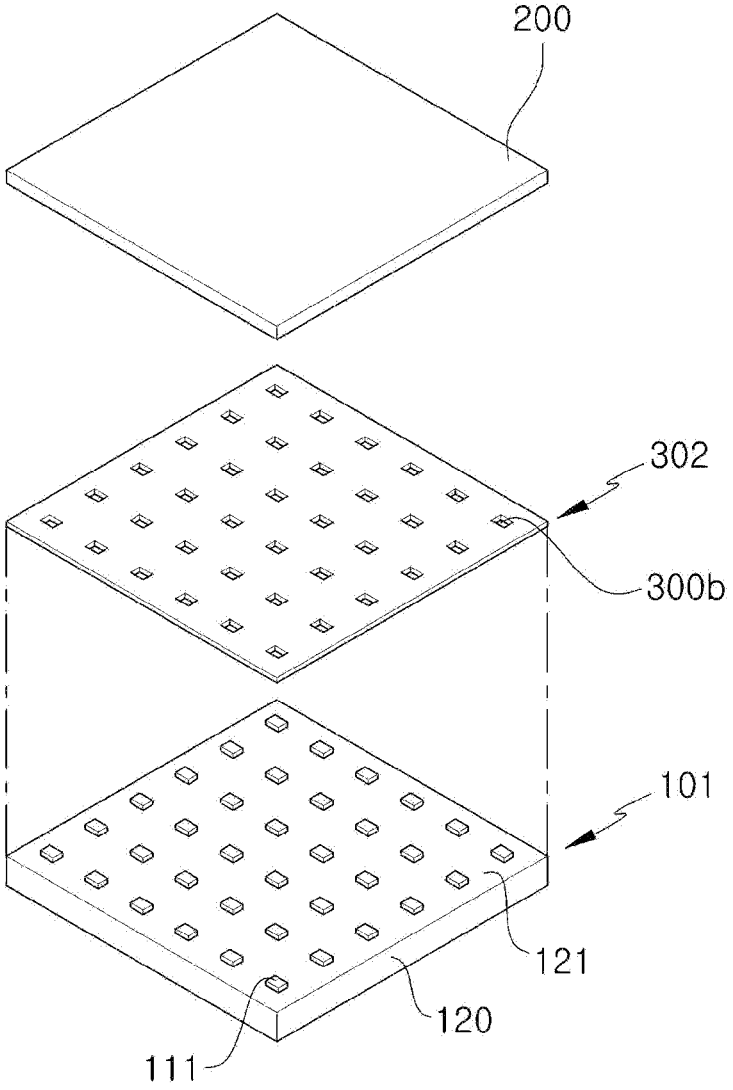
FIG. 8 is a schematic exploded perspective view of a lighting device according to another exemplary embodiment.

FIG. 8 is a schematic exploded perspective view of a lighting device according to another exemplary embodiment.

Referring to FIG. 8, a lighting device according to another exemplary embodiment includes a lighting unit 101, a lighting cover 200, and a reflective sheet 302.

The lighting unit 101 emits a light source by emitting an LED chip according to the application of electric energy, and may include an inverter that converts the LED chip into a power source suitable for driving and a control module that controls on/off of the power source.

The lighting unit 101 has a structure in which a plurality of LED chips 111 are electrically connected to a circuit board 120. Here, the circuit board 120 may be formed of a metal PCB made of a metal material, and a heat sink or the like for dissipating generated heat may be installed under the circuit board 120. In addition, the circuit board 120 includes a conductor layer and a non-conductor layer forming a conductive pattern, so that an electric energy may be applied to the LED chip 111.

The LED chip 111 in FIG. 8 is illustrated in a form protruding from a light source mounting surface 121 of the circuit board 120, but it may be configured in a form recessed in the circuit board 120.

The LED chip 111 may be composed of one or more combinations selected from various colors including red, orange, yellow, yellow green, pure green, and blue, and may be arranged in various patterns. Here, a top of the LED chip 111 is not coated with an encapsulant (and phosphor).

The lighting cover 200 is installed to be spaced apart from the lighting unit 101 and transmits a light source emitted from the lighting unit 101, and includes a conversion layer 210, a barrier film 220, and a composite film 230, as shown in FIG. 3.

The conversion layer 210 converts a wavelength of a light source (i.e., light) emitted from the LED chip 111 of the lighting unit 101 and a light source (i.e., light) reflected from the reflective sheet 302 to be emitted, and contains wavelength conversion material. Alternatively, the conversion layer 210 may have a structure in which a conversion layer including the wavelength conversion material for converting the wavelength of the light source and a scattering layer including a scattering material for scattering the light source are laminated, and may be configured as a mixture of the wavelength conversion material and the scattering material.

The barrier film 220 made of a PET (Polyester) material may be coated on one surface or upper and lower surfaces of the conversion layer 210.

In addition, one surface or the upper and lower surfaces of the barrier film 220 may be coated once more with the composite film 230 that increases support. Here, the composite film 230 may be a film-type substrate having excellent transparency and heat resistance.

The lighting cover 200 receives the light source (i.e., light) emitted from the LED chip 111 of the lighting unit 101, converts wavelength, and emits it.

The reflective sheet 302 is arranged on a light source mounting surface 121 and performs a function of reflecting the light source reflected from the lighting cover 200 back to the lighting cover 200, in which a through hole **300*b* is formed in the reflective sheet 302 corresponding to the plurality of LED chips 111**.

Figure 9:
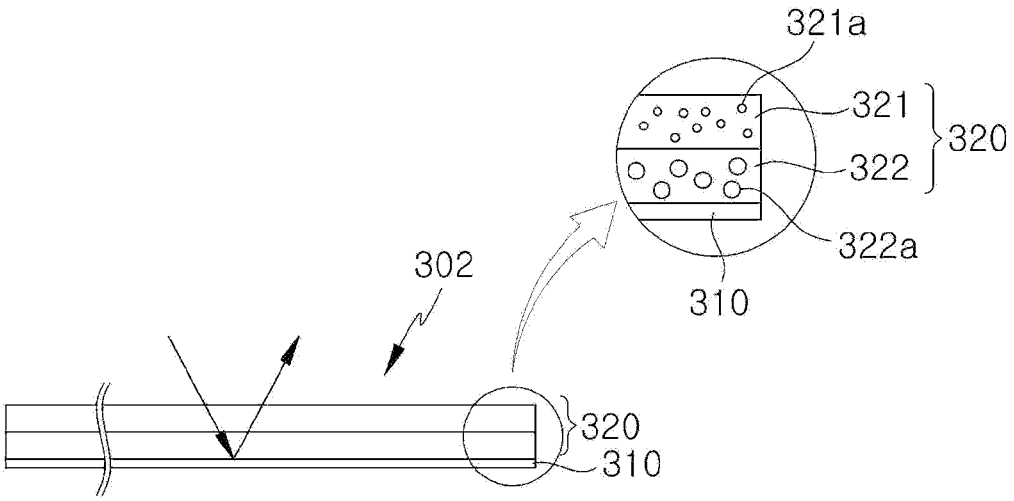
FIG. 9 is a side sectional view of a reflective sheet applied to a lighting device according to another exemplary embodiment.

FIG. 9 shows a side sectional view of a reflective sheet applied to a lighting device according to another exemplary embodiment.

Referring to FIG. 9, a reflective sheet 302 includes a reflective layer 310 and a base layer 320.

The reflective layer 310 reflects an incident light source. The reflective layer 310 may be composed of any one material selected from copper, silver, aluminum, tin, gold, brass, bronze, and stainless steel, which may expect high reflective efficiency, but any material that may reflect a light source may be used.

The base layer 320 is arranged on the reflective layer 310 to convert and/or scatter a wavelength of incident light, and includes wavelength conversion layer 321 and a scattering layer 322.

First, the wavelength conversion layer 321 converts the wavelength of the incident light.

Thus, the wavelength conversion layer 321 includes wavelength conversion material 321*a* for converting the wavelength of the incident light, in which the wavelength conversion material includes at least one of an inorganic phosphor, a quantum dot, and a perovskite. In other words, the wavelength conversion layer 321 may include one wavelength conversion material selected from an inorganic phosphor, a quantum dot, and a perovskite, or a mixture of two or more of them.

The scattering layer 322 includes a scattering material 322*a* that scatters incident light, and scatters and diffusely reflects the incident light.

The scattering material 322*a* may be selected from polyacrylate-based polymers such as PMMA and PS, silicone-based polymers such as PMSQ, and inorganic dispersants such as $SiO_2$, $TiO_2$, and $Al_2O_3$. Here, the scattering material has a wider range of scattering angles as a particle size decreases, in which a degree of scattering varies depending on a wavelength of a light source and a size of a particle. In other words, the scattering range may be adjusted by controlling the size of the scattering particles of the scattering material according to the wavelength of the light source.

In addition, the base layer 320 may be formed in a form in which wavelength conversion material 321*a* for converting a first wavelength of incident light into a second wavelength and a scattering material 322*a* for scattering the incident light are mixed.

Because the wavelength-converted light source is emitted from the lighting cover 200 even without coating the encapsulant on the LED chip, the color of the emitted light source may be varied by adjusting the particle size of the wavelength conversion material applied to the lighting cover 200. In addition, in the reflective sheet 302, because the reflected light source is wavelength-converted and reflected back toward the lighting cover 200, coating of the encapsulant for wavelength conversion may be omitted.

If the coating of the encapsulant on the LED chip is omitted, a manufacturing process of the lighting unit may be simplified, and a defect rate may be reduced according to the simplification of the process. In addition, heat generated from the LED chip is easily dissipated, resulting in longer lifespan and no discoloration caused by heat generation.

Figure 10:
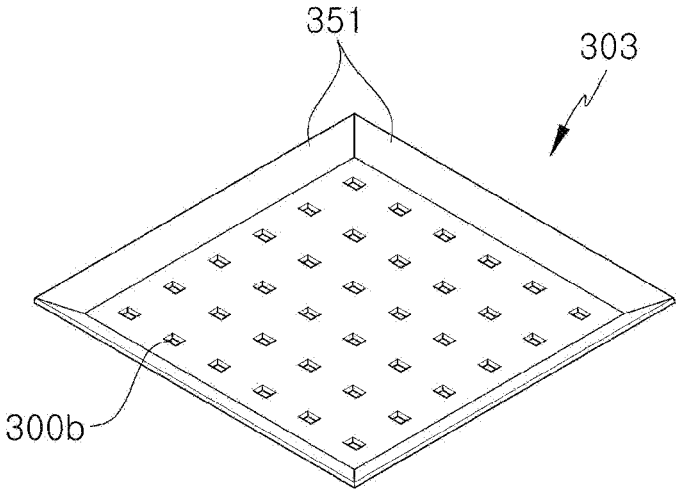
FIG. 10 is a perspective view of a reflective sheet applied to a lighting device according to another exemplary embodiment.

FIG. 10 shows a perspective view of a reflective sheet applied to a lighting device according to another exemplary embodiment.

Referring to the accompanying FIG. 10, a wing 351 bent in a direction of a lighting cover 200 is formed on an edge of a reflective sheet 303. Here, a bending degree (i.e., angle) and width of the wing 351 may be formed differently depending on a distance between the reflective sheet 303 and the lighting cover 200, a steering angle of a light source, and a use of a lighting device.

Because the wing 351 is formed on the reflective sheet 303, loss of the light source reflected from the lighting cover 200 and the light source reflected and returned may be further minimized. Therefore, relatively higher light efficiency may be expected compared to a reflective sheet in which the wing is not formed.

Here, it has been described that the reflective sheets 300, 301, 302, and 303 are disposed on the upper surface of the lighting unit, which means that the reflective sheet and the lighting unit are each manufactured, and the reflective sheet is adhered to the lighting unit or is arranged using a separate coupling means. However, the reflective sheets may be directly applied (i.e., coated) on the top of the lighting unit.

Figure 11:
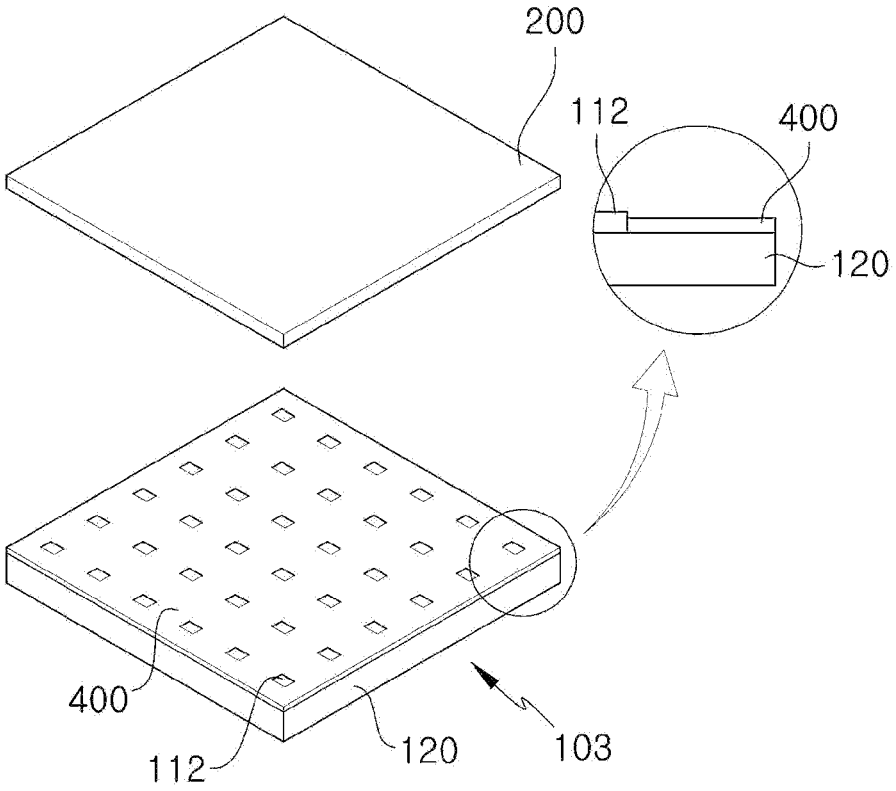
FIG. 11 is an exploded perspective view of a lighting device according to another exemplary embodiment.

FIG. 11 shows an exploded perspective view of a lighting device according to another exemplary embodiment.

Referring to FIG. 11, a lighting device according to another exemplary embodiment includes a lighting unit 103, a reflective area 400, and a lighting cover 200.

The lighting unit 103 emits a light source upon application of an electrical energy, and may include an inverter that converts the light source into a suitable power for driving and a control module that controls on/off of the power.

If a light emitting diode (LED) is used as the light source of the lighting unit 103, a plurality of LED chips 112 are electrically connected to a circuit board 120. Here, the circuit board 120 may be formed of a metal PCB made of a metal material, and a heat sink or the like for dissipating generated heat may be installed under the circuit board 120. In addition, the circuit board 120 includes a conductor layer and a non-conductor layer forming a conductive pattern, so that an electric energy may be applied to the LED chip 112. Furthermore, the LED chip 112 may be coated on an encapsulant (e.g., resin material and phosphor, etc.), but it does not matter if there is no coating of the encapsulant.

In other words, the lighting unit 103 may be any of an LED package or an LED barrier chip package.

According to design conditions, the LED chip 112 may be composed of one or more combinations selected from various colors including red, orange, yellow, yellow green, pure green, and blue, and may be arranged in various patterns.

The lighting cover 200 is installed to be spaced apart from the lighting unit 103, and transmits a light source emitted from the lighting unit 103.

The lighting cover 200 may be implemented in various forms depending on an environment in which the lighting device is installed. For example, as shown in FIG. 11, it may be configured in a planar shape, a hemisphere, or an arc shape in cross section, or a flexible material capable of being rolled or bent.

In addition, the lighting cover 200 may include a conversion layer 210 that converts a wavelength of incident light. In other words, as shown in FIG. 3, the lighting cover 200 may include a conversion layer 210, a barrier film 220, and a composite film 230.

Here, the conversion layer 210 converts a wavelength of a light source (i.e., light) emitted from the LED chip 112 of the lighting unit 103 and a light source (i.e., light) reflected from a reflective area 400 to be emitted, and contains wavelength conversion material. Alternatively, the conversion layer 210 may have a structure in which a conversion layer including the wavelength conversion material for converting the wavelength of the light source and a scattering layer including a scattering material for scattering the light source are laminated, and may be configured as a mixture of the wavelength conversion material and the scattering material.

The barrier film 220 made of a PET (Polyester) material may be coated on one surface or upper and lower surfaces of the conversion layer 210.

In addition, one surface or the upper and lower surfaces of the barrier film 220 may be coated once more with the composite film 230 that increases support.

The reflective area 400 is applied on the circuit board 120 between the LED chips, in which wavelength conversion layer including wavelength conversion material for converting a wavelength of incident light and a scattering layer including a scattering material for scattering the incident light are laminated and applied.

Figure 12:
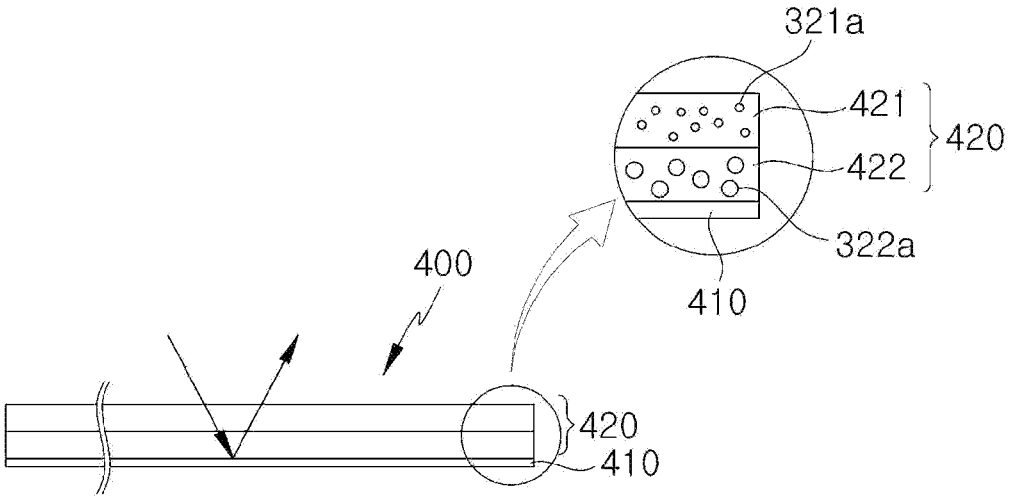
FIG. 12 is a partial side cross-sectional view of a reflective area applied to a lighting device according to another exemplary embodiment.

FIG. 12 shows a partial side cross-sectional view of a reflective area applied to a lighting device according to another exemplary embodiment.

Referring to FIG. 12, a reflective area 400 includes a reflective layer 410 and a base layer 420.

The reflective layer 410 reflects an incident light source. The reflective layer 410 may be composed of any one material selected from copper, silver, aluminum, tin, gold, brass, bronze, and stainless steel, which may expect high reflective efficiency, but any metal that may reflect a light source may be used.

The base layer 420 is arranged on the reflective layer 410 to convert and/or scatter a wavelength of incident light, and includes wavelength conversion layer 421 and a scattering layer 422.

First, the conversion layer 421 converts a wavelength of incident light.

Thus, the conversion layer 421 includes wavelength conversion material 321*a* for converting the wavelength of the incident light, in which the wavelength conversion material includes at least one of an inorganic phosphor, a quantum dot, and a perovskite. In other words, the conversion layer 421 may include one wavelength conversion material selected from an inorganic phosphor, a quantum dot, and a perovskite, or a mixture of two or more of them.

The scattering layer 322 includes a scattering material 322*a* that scatters incident light, and scatters and diffusely reflect the incident light.

The scattering material 322*a* may be selected from polyacrylate-based polymers such as PMMA and PS, silicone-based polymers such as PMSQ, and inorganic dispersants such as $SiO_2$, $TiO_2$, and $Al_2O_3$. Here, the scattering material has a wider range of scattering angles as a particle size decreases, in which a degree of scattering varies depending on a wavelength of a light source and a size of a particle. In other words, the scattering range may be adjusted by controlling the size of the scattering particles of the scattering material according to the wavelength of the light source.

Depending on design conditions, the base layer 420 may have a structure in which a mixture of a wavelength conversion material for converting a wavelength of incident light and a scattering material for scattering the incident light is applied.

In addition, incident light of the reflected light source sequentially passes through the conversion layer 421 and the scattering layer 422 of the base layer 420 and is reflected by the reflective layer 410, and the reflected light source is reflected by passing through the scattering layer 422 and the conversion layer 421 in sequence again. However, it is understood that this is only an example. For example, a lamination order of the scattering layer 422 and the conversion layer 421 may be changed according design conditions.

Because the reflective sheet 400 performs at least two wavelength conversion and two scattering until the incident light source is reflected and emitted, the efficiency of wavelength conversion and scattering is increased.

Figure 13:
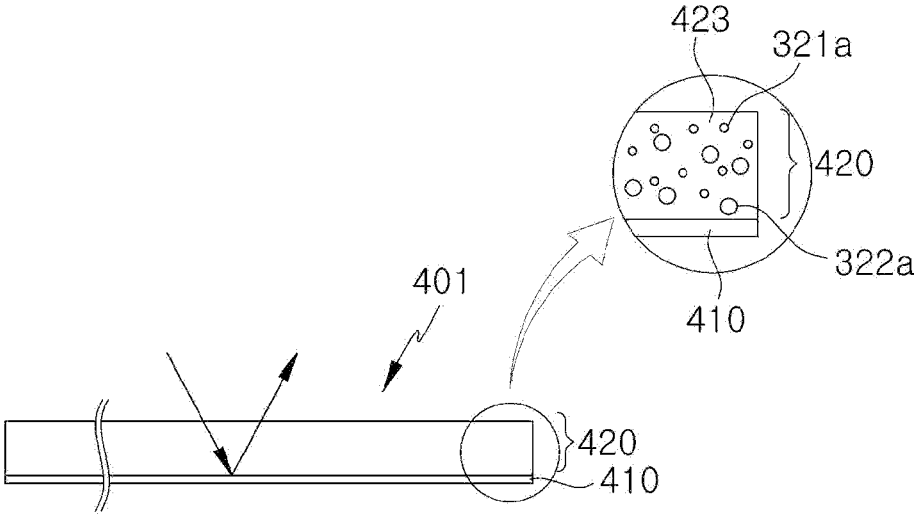
FIG. 13 is a partial side cross-sectional view of a reflective area applied to a lighting device according to another exemplary embodiment.

FIG. 13 shows a partial side cross-sectional view of a reflective area applied to a lighting device according to another exemplary embodiment.

Referring to FIG. 13, a reflective area 401 includes a reflective layer 410 and a base layer 420.

The reflective layer 410 reflects an incident light source, and the base layer 420 is formed of a mixed layer 423 arranged on the reflective layer 410 to convert and scatter a wavelength of incident light.

The mixed layer 423 includes a mixture of the wavelength conversion material 321*a* for converting the wavelength of the incident light and the scattering material 322*a* for scattering the incident light.

Here, the wavelength conversion material 321*a* includes at least one of an inorganic phosphor, a quantum dot, and a perovskite. In other words, the mixed layer 423 may include one wavelength conversion material selected from an inorganic phosphor, a quantum dot, and a perovskite, or a mixture of two or more of them.

The scattering material 322*a* may be selected from polyacrylate-based polymers such as PMMA and PS, silicone-based polymers such as PMSQ, and inorganic dispersants such as $SiO_2$, $TiO_2$, and $Al_2O_3$.

According to one or more exemplary embodiments, light reflected from a lighting cover is wavelength-converted and scattered in a reflective sheet and reflected back to the lighting cover. Therefore, light efficiency may be improved by minimizing the loss of light emitted from the lighting cover, and a pointing angle may be improved.

Moreover, various colors may be expressed by selecting wavelength conversion material and a particle size.

Also, even in a lighting unit that does not have an encapsulant (e.g., resin or phosphor) applied on an LED chip, it is possible to irradiate light of various colors by converting wavelength. Therefore, heat generated by the LED chip may be easily dissipated to extend a life expectancy of a lighting device. Furthermore, because a manufacturing process of the lighting unit using the LED chip is partially omitted, a defect rate may be reduced and it is possible to reduce a manufacturing cost of the lighting unit.

While exemplary embodiments have been described with reference to the accompanying drawings, it is to be understood by those skilled in the art that various modifications in form and details may be made therein without departing from the sprit and scope as defined by the appended claims. Therefore, the description of the exemplary embodiments should be construed in a descriptive sense and not to limit the scope of the claims, and many alternatives, modifications, and variations will be apparent to those skilled in the art.

What is claimed is:

1. A lighting device, comprising:

a lighting unit having an upper surface and mounting a plurality of light sources on the upper surface;

a lighting cover installed to be spaced apart from the lighting unit; and a reflective sheet installed on the upper surface of the lighting unit, the reflective sheet having a lower surface, and reflecting reflected light reflected from the lighting cover back toward the lighting cover, the reflective sheet including a plurality of through holes formed corresponding to the plurality of light sources, wherein the lower surface of the reflective sheet covers the upper surface of the lighting unit in a portion between the plurality of light sources, wherein a wavelength conversion layer for converting a wavelength of the reflected light reflected from the lighting cover is laminated on the reflective sheet, and wherein a scattering layer for scattering the reflected light reflected from the lighting cover is further laminated on the wavelength conversion layer of the reflective sheet.

2. The device of claim 1, wherein the wavelength conversion layer having wavelength conversion material comprises at least one of an inorganic phosphor, a quantum dot, and a perovskite.

3. The device of claim 1, wherein an edge of the reflective sheet is formed to be bent in a direction of the lighting cover.

4. The device of claim 1, wherein the light source is an LED bare chip package.

5. A lighting device, comprising:

a lighting unit having an upper surface and mounting a plurality of light sources on the upper surface;

a lighting cover installed to be spaced apart from the lighting unit; and a reflective sheet installed on the upper surface of the lighting unit, having a lower surface, and reflecting reflected light reflected from the lighting cover back toward the lighting cover, the reflective sheet including a plurality of through holes formed corresponding to the plurality of light sources, wherein the lower surface of the reflective sheet covers the upper surface of the lighting unit in a portion between the plurality of light sources, wherein the reflective sheet comprises a mixed layer in which a wavelength conversion material for converting a wavelength of the reflected light reflected from the lighting cover and a scattering material, different from the wavelength conversion material, for scattering the reflected light are mixed, the mixed layer of the reflective sheet being installed on the upper surface of the lighting unit on which the plurality of light sources are mounted, wherein the wavelength conversion material is one of an inorganic phosphor, a quantum dot, a perovskite and a combination thereof and the scattering material is one of $SiO_2$, $TiO_2$, $Al_2O_3$ and a combination thereof.

6. The device of claim 5, wherein an edge of the reflective sheet is formed to be bent in a direction of the lighting cover.

7. The device of claim 5, wherein the light source is an LED bare chip package.

8. A lighting device, comprising:

a lighting unit having an upper surface and mounting a plurality of light sources on the upper surface and a reflective area is formed on the upper surface between the plurality of light sources; and a lighting cover installed to be spaced apart from the lighting unit, wherein the reflective area comprises a reflective layer that reflects reflected light reflected from the lighting cover back toward the lighting cover, the reflective layer including a plurality of through holes formed corresponding to the plurality of light sources, and wherein a wavelength conversion material for converting a wavelength of the reflected light is laminated in a first layer included in the reflective area and a scattering material for scattering the reflected light is laminated in a second layer included in the reflective area.

9. The device of claim 8, wherein the wavelength conversion material comprises at least one of an inorganic phosphor, a quantum dot, and a perovskite.

10. The device of claim 8, wherein the light source is an LED bare chip package.

11. A lighting device, comprising:

a lighting unit having an upper surface and mounting a plurality of light sources on the upper surface and a reflective area is formed on the upper surface between the plurality of light sources; and a lighting cover installed to be spaced apart from the lighting unit, wherein the reflective area comprises a reflective layer that reflects reflected light reflected from the lighting cover back toward the lighting cover, the reflective layer including a plurality of through holes formed corresponding to the plurality of light sources, and wherein a mixture of a wavelength conversion material for converting a wavelength of the reflected light and a scattering material, different from the wavelength conversion material, for scattering the reflected light is applied on the reflective layer, wherein the wavelength conversion material is one of an inorganic phosphor, a quantum dot, a perovskite and a combination thereof and the scattering material is one of $SiO_2$, $TiO_2$, $Al_2O_3$ and a combination thereof.

12. The device of claim 11, wherein the light source is an LED bare chip package.

* * * * *